United States Patent [19]

Hoover et al.

[11] 4,397,732

[45] Aug. 9, 1983

[54] PROCESS FOR COAL LIQUEFACTION EMPLOYING SELECTIVE COAL FEED

[75] Inventors: David S. Hoover, New Tripoli; Edwin N. Givens, Bethlehem, both of Pa.

[73] Assignee: International Coal Refining Company, Allentown, Pa.

[21] Appl. No.: 347,836

[22] Filed: Feb. 11, 1982

[51] Int. Cl.[3] ..... C10G 1/06

[52] U.S. Cl. ..... 208/8 LE; 208/10

[58] Field of Search ..... 208/8 LE, 10

[56] References Cited

U.S. PATENT DOCUMENTS 4,244,812 1/1981 Baldwin et al. ..... 208/8 LE

OTHER PUBLICATIONS

Given et al, "Dependence of Coal Liquefaction Behavior on Coal Characteristics, 1, Vitrinite-Rich Samples", *Fuel*, vol. 54, Jan. 1975.

Bent & Brown, "The Infra-Red Spectra of Macerals", *Fuel*, vol. 40, p. 47, 1961.

"Coal", Encyc. of Chemical Technology, Kirk-Othmer, vol. 6, 3rd ed. pp. 228, 238, 247, 282.

*Primary Examiner*—Delbert E. Gantz

*Assistant Examiner*—Lance Johnson

*Attorney, Agent, or Firm*—Mark F. Wachter

[57] ABSTRACT

An improved coal liquefaction process is provided whereby coal conversion is improved and yields of pentane soluble liquefaction products are increased. In this process, selected feed coal is pulverized and slurried with a process derived solvent, passed through a preheater and one or more dissolvers in the presence of hydrogen-rich gases at elevated temperatures and pressures, following which solids, including mineral ash and unconverted coal macerals, are separated from the condensed reactor effluent. The selected feed coals comprise washed coals having a substantial amount of mineral matter, preferably from about 25-75%, by weight, based upon run-of-mine coal, removed with at least 1.0% by weight of pyritic sulfur remaining and exhibiting vitrinite reflectance of less than about 0.70%.

30 Claims, 1 Drawing Figure

PROCESS FOR COAL LIQUEFACTION EMPLOYING SELECTIVE COAL FEED

The Government of the United States of America has rights in this invention pursuant to Contract No. DE-AC05-780R03054 (as modified) awarded by the U.S. Department of Energy.

TECHNICAL FIELD

The invention pertains to direct liquefaction of coal and, more particularly, it provides an improved process for coal liquefaction wherein coal conversion into solvent refined coal distillates, most notably pentane soluble oils, is improved. A novel method for selecting feed coals for direct liquefaction to provide the aforementioned improvements is provided, as well as an improved coal liquefaction process employing selective coal feed.

BACKGROUND

Coal may be refined by a direct liquefaction process wherein the coal is liquefied by subjecting it to a hydrogen donor solvent in the presence of a hydrogen rich gas at elevated temperature and pressure. After dissolution the products are separated into gaseous material, distillate fractions and vacuum distillation bottoms. The residum containing entrained mineral matter and unconverted coal macerals is subjected to a solid/liquid separation, or deashing step, which can be any of several methods known to those skilled in the art. From the dashing step one or more streams of solvent refined coal (herein also referred to as "SRC") products are obtained which are free of ash minerals and unconverted coal. Desired SRC products include pentane soluble oils useful as liquid fuels, and solids, both of which are low in sulfur content.

The coal typically subjected to a direct liquefaction process is usually specified as being of a rank lower than anthracite, such as bituminous, sub-bituminous or lignite coals or mixtures thereof. Typically, the direct liquefaction process is not dependent on whether such coals are used directly from the mine, (e.g. "run-of-mine" coal) or whether they are pretreated (e.g. washed) to any of several levels to remove a portion of the entrained mineral matter. The coal, either run-of-mine or washed coal processed through a coal preparation plant, is ground to a size typically less than 8 mesh (Tyler Screen Classification), or more preferentially less than 20 mesh, and is dried to remove substantial moisture to a level for bituminous or sub-bituminous coals of less than about 4 percent by weight. The improved process of the invention employs a specific selection process which reflects upon the coal's composition and makes possible improved results upon subjection to direct liquefaction.

Coals are complicated mixtures of various distinct carbonaceous and non-carbonaceous materials found in nature. Due to the mechanism of geological formation of coals, they are nearly never found to be uniform in composition.

Not only are tremendous differences found in the coals taken from different seams within any particular area, but considerable differences are observed even within coals found in a particular seam. To those knowledgeable in coal composition, even coals within a narrow finite geographical area may differ considerably in composition, both as to type and amounts of mineral matter, as well as type and amounts of carbonaceous maceral composition.

Within any given mine the uniformity of the coal may vary to some degree, but during the mining process, the coal strata are mixed and intermingled. This tends to average out these greater distances along a particular coal strata, the differences may be so great between different mines or portions of the strata that even the intermingling and blending associated with removal of the coal often yields mined coals which differ significantly in their properties and composition.

Differences in coals are reflected in the quantity of minerals, their specific types and form of occurence, as found in nature. Between mines the relative amounts of iron minerals, chloride ion or calcium materials may differ significantly. The carbonaceous materials will also differ significantly between mines or even different portions of a large coal strata.

One method of improving the value of coal being removed from a seam is physical beneficiation, wherein "run-of-mine" material is separated by conventional techniques which take advantage of physical structure of the coal to remove mineral matter. Typically, one quarter to three quarters of the mineral matter is separated and removed, without significant loss in organic fuel value of the resulting "washed" coal.

Fortunately, pyrite, a sulfur-rich mineral the sulfur content of which is referred to herein as "pyritic sulfur", is one material that can be readily eliminated by treatment of run-of-mine coal to give lower sulfur-content products that burn in a more environmentally acceptable manner.

Several methods by which coal is treated to free it from undesirable inorganic elements are known by those skilled in the art and can be employed in accordance with the invention. Many of these techniques utilize gravity separation methods, since the inorganic material is more dense than the valuable carbonaceous components. For example, in the process of crushing coal, some of the mineral material is freed from the carbonaceous material. Generally, the smaller the crushed particles, the more impurities (i.e. minerals) are freed. As particles are generated, a sizing step may be employed to reject or recycle the larger particles. The crushed material can be subjected to a washing step, in which insoluble impurities are separated on the basis of their inherently greater specific gravity. In one such method, known as jigging, particles are stratified by water pulsation into a lighter fraction, which comprises mainly the carbonaceous components, and a heavier fraction which contains impurities. In another conventional coal washing process, a dense media is used which cleans by specific gravity. The heavier mineral materials do not float in the fluid slurry, whereas the carbonaceous materials do float and can be separated. As practiced in the industry, the dense media systems are commonly generated by suspending finely ground magnetite or sand in water to various levels having different specific gravities.

Other washing processes can also be utilized on finely ground coal particles. Dense-media cyclones, concentrating tables and floth flotation cells are familiar to those skilled in the art. All of the above methods serve to enrich the carbonaceous material by separating out refuse and mineral matter and can be utilized in accordance with the invention to provide a washed feed coal having substantial amounts of mineral matter removed. By removing as much mineral and refuse material as possible by the conventional methods of jigging, dense media separation or like means, the refuse that may be fed to the gasification unit in the liquefaction process can be minimized. Likewise, by removing the maximum amount of pyrite, the process demands for expensive hydrogen to convert the pyrite to hydrogen sulfide and pyrrhotite, which occurs under the operating conditions of direct liquefaction, is minimized. Keeping the hydrogen sulfide to a minimum likewise reduces the size of the gas scrubbing equipment.

In the liquefaction process, these washed or beneficiated coals have excellent potential, because much of the undesired mineral material is kept from entering the reaction system. Although many potential benefits of such coal preparation to the liquefaction process are known in the art, there are considerable differences in the way that various washed coals will behave in the liquefaction process. The nature of the carbonaceous fraction of coals is believed to be an important factor effecting the degree of coal conversion that will occur. For purposes of this invention, "coal conversion" means the relative amount of reacted (i.e. liquefied) coal to the total coal values processed.

It has long been recognized that liquefaction is heavily dependent on the maceral and, in particular, the vitrinite content of the feed coal. Fusinite, on the other hand, is the maceral most commonly associated with lack of conversion. Persons skilled in coal characterization art commonly group macerals into a group termed "total reactive macerals", which as used herein refers to the sum of the vitrinite, pseudovitrinite sporinite, resinite, cutinite, micrinite, and one third ($\frac{1}{3}$) of the semifusinite.

American coals that contain a large amount of total reactive macerals generally have been considered good candidates for the liquefaction process. However, experience has taught that even though coals may have similar contents of total reactive macerals, the degree of liquefaction and the relative product distributions still differ considerably. It has been recognized by Given et al in an article entitled "Dependence of Coal Liquefaction Behavior on Coal Characteristics 2. Role of Petrographic composition", which was published in FUEL, Vol. 54, January 1975, that petrographic composition is an important factor in determining liquefaction behavior. However, these authors indicate that the composition of the inorganic matter in the coal may be the most significant factor and that while maceral distribution is an important factor, the effects of various macerals was not well enough understood to serve as a basis for making confident predictions.

In U.S. Pat. No. 4,227,991 to Carr et al, coal conversion and yields of pentane soluble oils are enhanced by controlling the content and particle size of mineral solids having catalytic effect, including pyrite, which are of median diameter. While it is disclosed that a variety of feed coals can be used and, preferably those which upon dissolution generate smaller and more catalytically active inorganic mineral residue, the principle technique taught is to recycle process slurry containing the desired inorganic mineral matter and to "spike" this recycle stream with pyrite, as an additive. This increases the pyrite content of the slurry being subjected to liquefaction, but also results in increased levels of hydrogen consumption.

Thus, there exists a need, which is fulfilled by the present invention, for a reliable method by which to select coals for processing by direct liquefaction to obtain improved coal conversion and also to increase yields of higher fuel value pentane soluble coal-derived oils, preferably without high levels of mineral matter and hydrogen consumption. Such an ability to identify and selectively process coals that offer better levels of conversion and better product distributions offers the potential of carrying out a more economically and technically advantageous direct liquefaction process.

SUMMARY OF THE INVENTION

In accordance with the present invention, the direct coal liquefaction process is improved by using feed coals which are selected from processing on the basis of the specifications set forth herein, which in one essential aspect analyze the organic content of the coals. We have discovered through extensive effort, requiring considerable technical skill, that washed coals having a substantial amount of mineral matter removed, yet still possessing at least 1%, by weight, of pyritic sulfur, and also indicating a smaller percent of vitrinite reflectance, preferrably less than about 0.70%, are more valuable for liquefaction, than conventional feed coal materials.

In accordance with one preferred embodiment of the invention, a method is provided for the selection of feed coal for processing by direct liquefaction to produce low-ash, low-sulfur hydrocarbon products, including synthetic fuels. Run-of-mine coal is treated to remove a substantial portion of mineral matter and produce a washed coal. The vitrinite reflectance of the washed coal is measured. If the vitrinite reflectance is less than about 0.70% and if the washed coal also has a minimum pyritic sulfur content of at least about 1.0%, by weight, it is selected for use as a feed coal for direct liquefaction which will yield higher coal conversion and increased quantities of pentane soluble oils of high fuel value.

An improved direct coal liquefaction process is provided which utilizes selective feed coal, in accordance with the invention. Also, provided is an integrated direct coal liquefaction process which includes feed coal pretreatment and selection steps in accordance with another embodiment of the invention.

It is, therefore, a primary objection of the invention to provide a reproducible, reliable and cost effective method for identifying and selecting the best coal materials for processing by direct liquefaction to provide improved coal conversion and better yields of high fuel value, pentane soluble oils.

It is also an object of the invention to provide an improved direct coal liquefaction process which facilitates better coal conversion and greater yields of pentane soluble oil distillate products by employing selective coal feed, and thereby leading to more economical and efficient synthetic fuel production.

Finally, it is also an object of the invention to provide an integrated coal liquefaction process which incorporates pretreatment and selection of run-of-mine coals and provides the desired higher coal conversions and yields of pentane soluble oils.

Other objects and advantages of the invention will be apparent to those skilled in the art from study of the following description and the appended claims.

DESCRIPTION OF PREFERRED EMBODIMENT AND BEST MODE OF PRACTICING THE INVENTION

Figure 1:
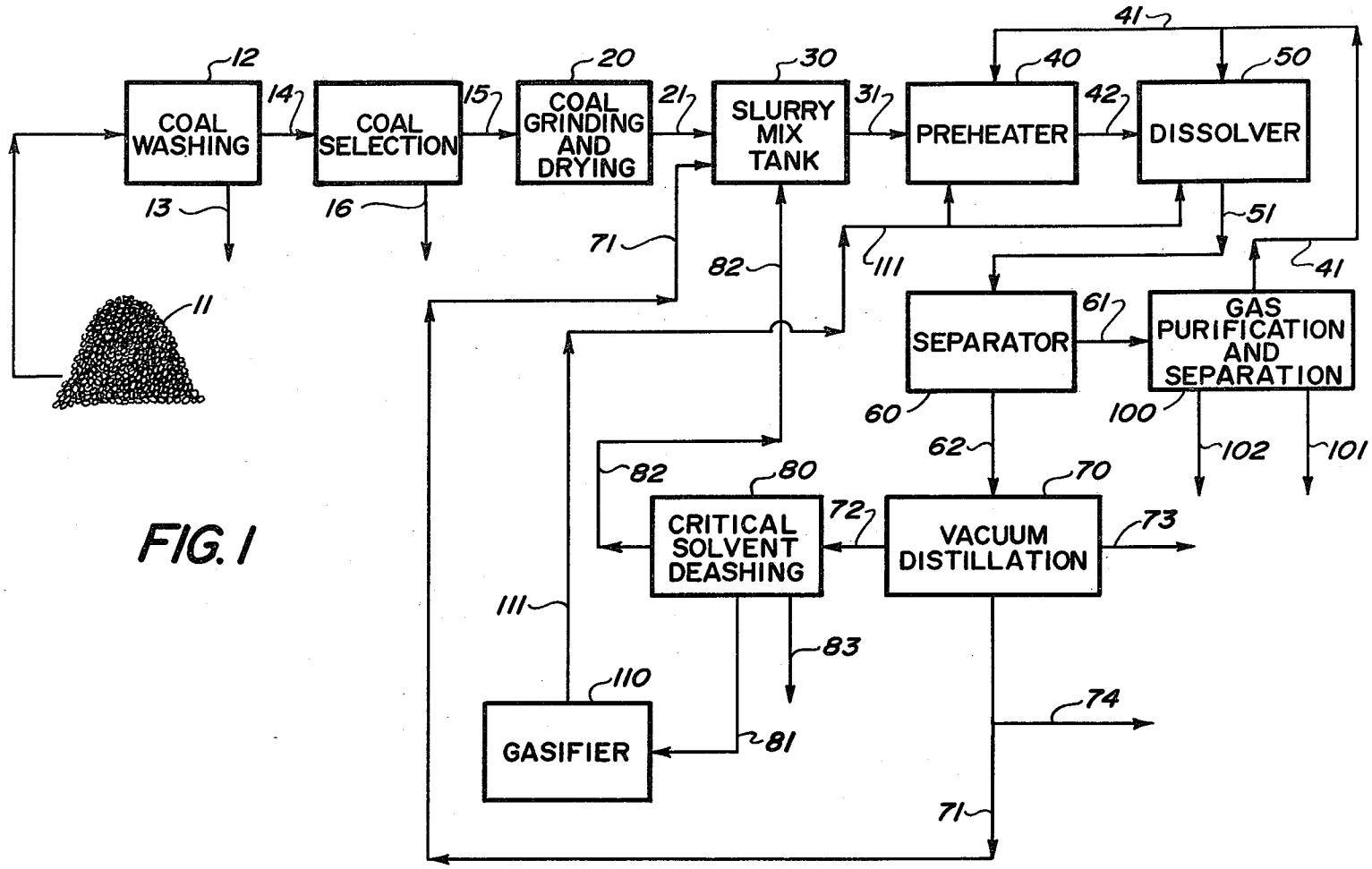
FIG. 1 is a schematic flow diagram showing improved selection and direct liquefaction of coal in accordance with an embodiment of the invention wherein the coal preparation, selection and liquefaction processing functions are integrated.

In general, it has been known that higher levels of pyritic sulfur in coals, indicative of higher amounts of mineral pyrite, can lead to higher coal conversions and often improved yields of pentane soluble oil in the liquefaction process. However, higher levels of pyritic sulfur require greater amounts of expensive hydrogen in the liquefaction process, as previously indicated.

In accordance with the invention, we have discovered that, given a particular minimal level of pyritic sulfur in various coals, those having a lower vitrinite reflectance, as indicated, produce improved coal conversion and higher yields of pentane soluble oils, as product.

Vitrinite reflectance is an analytical technique utilized by those skilled in coal characterization to determine the level of geochemical maturation of a coal, independent of its relative component composition. Vitrinite reflectance is determined by impinging a known quantity of light onto a polished vitrinite surface and measuring the amount of light reflected back from the surface. For example, ASTM D-2798 can be utilized to determine vitrinite reflectance. For purposes of the invention, ASTM D-2798 has been used and vitrinite reflectance values are expressed in terms of mean-maximum percent. As will be apparent to those skilled in the art, other methods of measuring vitrinite reflectance can be employed, with vitrinite reflectance values being expressed on an equivalent basis.

The amount of reflected light is dependent on the refractive and absorptive indicies of vitrinite and is hence believed to serve as an index of the degree of aromaticity of level of fused carbon ring content. It provides an analytical means to differentiate between coals of comparable vitrinite content to identify the level of fused carbon rings which must be broken to effect liquefaction.

Since vitrinite reflectance is measured only on the vitrinite maceral present in a coal, its determination is independent of gross sample composition. Consequently, the vitrinite reflectance of a washed coal will be the same as that of the run-of-mine coal precursor, although it will vary from coal mine to coal mine. For purposes of the invention, the vitrinite reflectance can be measured at any stage of pretreatment or prior to pretreatment, although preferably it is measured after pretreatment on a sample of the washed coal.

In accordance with the novel manner of selecting feed coals for direct liquefaction of the invention, not only is feed coal utilized which has most of the non-catalytic mineral material removed from the run-of-mine coal, but the degree of coal conversion and yields of high value liquefaction products can be optimized for greatest efficiency and commercial benefit.

In accordance with one preferred embodiment of the present invention, feed coal is selected on the basis of having substantial amounts, preferrably from 25 to 75 wt%, of mineral matter removed, while retaining at least 1.0 wt% of pyritic sulfur, and having less than about 0.70% vitrinite reflectance. For purposes of this invention, any conventional technique for measuring pyritic sulfur content may be utilized, such as ASTM-2492.

The selected feed coal is pulverized and slurried with a pasting solvent or process solvent, at temperatures ranging from ambient up to about 450° F. (232.2° C.). For purposes of the invention, the term "pasting oil" means coal derived oil, preferrably obtained in the coking of coals in a slot oven, and commonly referred to as creosote oil, anthracene oil or any equivalent type, or it may be a "process-derived solvent", which term may be used interchangeably with pasting oil.

The concentration of feed coal in the slurry preferably ranges from about 20 to 55 percent by weight. In the slurry mix tank, which is preferably maintained at elevated temperature in order to keep the viscosity of the process solvent sufficiently low enough to pump, moisture entrained in the feed coal is removed. If desired, the temperature in the slurry mix tank can be maintained at a higher level so as to allow additional moisture to escape as steam.

The coal slurry from the slurry mix tank is passed to a pumping unit that forces the slurry into a system maintained at higher pressure, usually from about 500 to 3200 psig (35.2 to 225.0 kg/cm$^2$ gauge). The slurry is mixed with a hydrogen rich gaseous stream at a ratio ranging from about 10,000 to 40,000 SCF (standard cubic feet) per ton (312 to 1,248 m$^3$ per metric ton) of coal feed.

The resulting three phase gas/slurry stream is then introduced into a preheater system, preferably comprised of a tubular reactor having a length to diameter ratio greater than about 200 and, more preferably, greater than about 500. The temperature of the three phase gas/slurry stream is increased from approximately the temperature in the slurry mix tank to an exit temperature of about 600° to 850° F. (315.6° to 454.4° C.).

The preheated slurry is then passed to one or more dissolver vessels, which preferably are tubular reactors operated in an adiabatic mode without addition of significant external heat. The length to diameter ratios of the dissolver vessels are usually considerably less than are employed in the preheater system. The slurry exitting the preheater normally contains little undissolved coal to enter the dissolver vessel. In the preheater, the viscosity of the slurry changes as the slurry flows through the tube. It initially forms a gel like material which shortly diminishes sharply in viscosity to a relatively freely flowing fluid, which enters the dissolver where other changes occur.

The coal material and recycle solvent comprising the bulk of this fluid undergo a number of chemical transformations in the dissolver including, but not necessarily limited to: further dissolution of the coal in liquid, hydrogen transfer from the recycle solvent to the coal, rehydrogenation of recycle solvent, removal of heteroatoms (e.g. sulfur, nitrogen, oxygen, etc.) from the coal and recycle solvent, reduction of certain components of the coal ash, (e.g., $FeS_2$ to FeS), and hydrocracking of heavy coal liquids. The mineral matter entrained in the fluid can, to various extents, catalyze the above reactions.

The superficial flow through the dissolver will generally be at a rate from about 0.003 to 0.1 ft/sec (0.091 to 3.048 cm/sec) for the condensed slurry phase and from about 0.05 to 3.0 ft/sec (1.524 to 91.44 cm/sec) for the gas phase. These rates are selected to maintain good agitation in the reactor and thereby insure good mixing. The ratio of total hydrogen gas to coal hydrogen slurry is maintained at a level sufficient to insure an adequate concentration in the exit slurry to prevent coking. The particular selection of flow through the reactor at any given time is chosen such that the coal slurry, with its incipient mineral particles, move through the reactor with minimal entrainment of larger particles that are unable to exist the reactor. The quantity of solids that accumulate in the dissolver at these velocities is usually quite small, based on feed. In the preferred process, the concentration of solids in the dissolver is sufficient to catalyze the liquefaction reaction.

Because of the inherent mineral particle accumulation phenomena which develops over time in the dissolver, a solids withdrawal system is preferably provided for the dissolver, so that excessive accumulated solids can be removed from the system, as may be required from time to time. Since accumulated solids are related in large part to the agglomeration of carbonaceous and mineral particles in the reactor system, the solids removal system should be designed to obviate this problem.

The effluent from the first dissolver may be either passed to subsequent dissolver vessels, either before or after going through one or more phase separators, or it may be passed directly to one or more phase separators, after which it is passed on to a vacuum distillation system. Separator gaseous effluent may be flashed, if desired, to a gas system where ultimately the vapors are cooled and let down in pressure to recover light gases, water and organic rich condensate. These separations, collections and gas purification are typically accomplished in a gas treatment area, where the overhead from each separator is combined.

The underflow from the phase separator between dissolvers, before being passed to the next dissolver, may be mixed with fresh hydrogen and injected into the next dissolver vessel. Adequate hydrogen is fed to the next dissolver to maintain good agitation in the reactor. Introducing fresh hydrogen to the dissolver in this manner increases the hydrogen partial pressure significantly, since much of the CO, $CO_2$ and water have been removed after the first dissolver. The higher partial pressure will insure better reaction by hydrogen incorporation into the recycle solvent. The higher partial pressure of hydrogen will also promote sulfur removal.

The number of dissolvers utilized in the process of the invention may be one or more. The concentration of heavy carbonaceous material in a downstream dissolver will be greater than in the first dissolver. By having a higher concentration of the residue and thereby the capability of selectively treating this fraction, a greater amount of distillate yield can be promoted.

The dissolver contents from the final dissolver are removed, and passed to a flash separating zone, where the effluent is flashed. The overhead is cooled to a range of 100° to 150° F. (37.8° to 65.6° C.) in heat exchangers which may be in multiple stages, as is known in the art. Higher separator temperatures may be desirable, up to within about 20° to 50° F. (11.1° to 27.8° C.) of the reactor outlet temperature. Light gases (e.g., $H_2$, $H_2S$, $CO_2$, $NH_3$, $H_2O$ and $C_1$–$C_4$ hydrocarbons) are removed in the flashing operation. These gases may be scrubbed to remove acidic or alkaline components, and the hydrogen and/or lower hydrocarbons preferably recycled to various stages in the process or they may be consumed for plant fuel. The remaining separator effluent consisting of liquid solid slurry is passed to a vacuum distillation system, where at least three streams are obtained; (1) light distillate boiling up to 400° F. (204.4° C.), (b) middle distillate having a boiling range about 350° to 1050° F. (176.7° to 565.6° C.) and (c) solvent refined coal having an initial boiling point about 850° F. (454.5° C.). The middle distillate provides not only the desired pentane soluble oil product, but also a portion provides the process derived solvent stream which is recycled to the slurry mix tank and is utilized to help make the initial feed coal/recycle solvent slurry.

In one embodiment of the improved coal liquefaction process of the invention, upstream of the vacuum distillation step the liquid/solid separator effluent is passed through a filter element, which may be comprised of a screen, such as a Johnson screen or other appropriate medium, on which solids are retained, but through which pass the solids-free SRC product. The use of hydroclones before such a filter is commonly employed and may be utilized in accordance herewith to advantage under appropriate circumstances. The effluent from this solids separation step is then passed to the vacuum distillation tower for removal of process derived solvent from the residual solids and SRC.

Other solid separation equipment that can be employed include but are not limited to those which employ other porous media, such as sintered plates, or centrifuges which utilize a relative particle settling phenomena.

In a preferred embodiment of the improved process of the invention, a solvent separation process is used, such as the Kerr-McGee critical solvent deashing (herein also referred to as "CSD") process, as described in U.S. Pat. No. 4,119,523. The vacuum distillation still or tower is typically operated at a pressure from about 1 to 5 psi (0.07 to 0.35 kg/cm$^2$) and a bottom temperature of about 500° to 700° F. (260° to 371.1° C.). Light liquids are recovered either from this tower or a downstream distillation system. The process derived recycle solvent can also be obtained and recycled to the coal slurry mix tank. The hot vacuum still bottoms, which contain dissolved carbonaceous product, minerals, and unconverted coal macerals, plus a small amount of residual process solvent, are transferred to a deashing mix tank to which is added the critical deashing solvent. The weight ratio of deashing solvent to vacuum still bottoms will range from about 1 to 10.

After complete mixing, the resulting slurry is introduced into a first separator at a pressure ranging from almost 750 to about 1000 psig (52.7 to about 70.3 kg/cm$^2$ gauge), at a temperature from about 450° to 630° F. (232.2° to 332.2° C.). Two phases separate; (1) a light phase comprising primarily deashing solvent and dissolved coal, and (2) a heavier phase comprising primarily solid insoluble mineral ash, undissolved coal, dissolved coal, and a small amount of deashing solvent. The heavy phase is withdrawn from the lower portion of the separator. Deashing solvent is flashed off and passed to the deashing mix tank. The remaining solvent, insoluble ash, undissolved coal and the dissolved coal, referred to jointly as "ash concentrate", is removed from the system and passed to equipment for hydrogen generation, preferably a gasifier.

The light phase formed in the first separator is withdrawn and passed into a second separation vessel. Here, the temperature of the light phase is increased from about 600° to about 850° F. (315.6° to about 454.4° C.), and preferably from about 630° to about 700° F. (332.2° to about 371.1° C.), while the pressure is usually maintained at about 750 to 1000 psig (52.7 to about 70.3 kg/cm$^2$ gauge), as a result of which separation occurs with a light phase rising to the top of the second separator vessel and a heavy phase settling to the bottom. The heavy phase is withdrawn by reduction in pressure. Deashing solvent is flashed off and recycled for reintroduction into the critical solvent deashing system. The remaining solvent-free material is molten deashed SRC product.

The operation of the second separator in the CSD system can also be in a manner such as to increase the density of the overhead fraction which includes a portion of the soluble coal product. This soluble SRC material may be included as a portion of overall process solvent. As disclosed in U.S. Pat. No. 4,070,268, the portion of the soluble SRC from the second CSD stage after recovery from the third stage settler underflow can be recombined with the process solvent which is isolated from the vacuum distillation tower. This "heavier" fraction of the process solvent system is generally referred to as light SRC, (LSRC) since the composition as defined by solvent separation is primarily deficient in any benzene insoluble material. When operating in such a manner as to make a light SRC material, the bottoms from the second separator will tend to be richer in benzene insoluble material.

One specific embodiment of this invention is shown in FIG. 1. Run-of-mine coal 11 taken from a storage pile is passed through a coal preparation facility 12 wherein a substantial amount of mineral material, preferably about 25 to 50%, and most preferably up to 75%, by weight, is removed. A clean, lower mineral washed coal 14 is obtained containing at least about 1.0% by weight of pyritic sulfur and having a higher carbonaceous content than run-of-mine coal 11. A mineral rich reject 13 is discarded.

Washed coal 14 is then subjected to a coal selection step, wherein the vitrinite reflectance and pyritic sulfur are evaluated. Vitrinite reflectance can be determined at this stage or any previous stage of mining and/or preparation of the coal. Provided that the washed coal 14 has a vitrinite reflectance of less than about 0.70%, it is passed as selected feed coal 15 to a grinding and drying facility 20; otherwise, reject washed coal 16 is not utilized as coal feedstock for the liquefaction process. In grinding and drying facility 20 selected feed coal 15 is ground to a fine mesh size and dried to remove moisture to produce a pulverized and dried feed coal 21.

Pulverized and dried feed coal 21 is passed to a slurry mix tank 30 where it is slurried with process derived solvent 71, plus any other downstream product, such as light deashed solvent refined coal 82. Since slurry of coal in solvent is typically effected at temperatures up to 450° F. (232.2° C.), additional moisture is removed from the coal. The slurried coal 31 is passed to a preheater 40 where it is mixed with hydrogen 41 from downstream gas purification and separation equipment 100. Additional makeup hydrogen 111 from a gasifier system 110 may also be added, as needed. In preheater 40, slurried coal 31 is passed at a high flow rate through tubular pipe while being heated to about 800° F.

The preheater effluent 42 is passed to dissolver 50. Although not shown in FIG. 1, hydrogen 41 from the gas purification and separation system 100, or make-up hydrogen 111 from gasifier 110 can be mixed with the preheater effluent 42 before passing to dissolver 50. The dissolver 50, as shown in FIG. 1, can represent one or several dissolvers upstream of which hydrogen can be added to any or all, if so desired.

The reacted effluent 51 from dissolver 50 is passed to a separator system 60, wherein gaseous product 61 is separated and sent to gas separation and purification system 100 for condensation, separation and purification to produce hydrogen-rich recycle stream 41 from which hydrogen sulfide, ammonia and gaseous products 101 are separated and collected. Also, separated and collected are condensed carbonaceous materials 102 including phenols, hydrocarbons and other lighter liquefaction products.

The underflow condensed product 62 from separator 60 is passed to a vacuum distillation system 70. Light distillate product boiling up to approximately 450° F. (232.2° C.) is collected and removed as product 73. A middle distillate boiling from, for example, 450° to 850° F. (232.2° C. to 454.4° C.) is collected, with a portion being recycled as process derived solvent 71 to slurry mix tank 30. The remaining portion of the middle distillate which represents the increased yields of pentane soluble oils having high fuel value, is removed as middle distillate product 74.

The bottoms residue 72 from vacuum distillation system 70 is passed to critical solvent deashing unit 80. Insoluble material 81, comprising primarily coal plus mineral ash material, is separated and passed to gasifier 110. Various deashed fractions may be produced in 80, in lieu of a single product, if so desired. A completely benzene-soluble light solvent refined product (LSRC) 82 may be recovered and passed to slurry mix tank 30, if so desired. A deashed solvent refined coal (SRC) product 83 is recovered for sale or further processing.

In the flow scheme shown in FIG. 1, coal preparation facility 12 may be located and the coal selection step 15 may be conducted at the coal liquefaction plant site, or remotely, such that washed coal and/or preselected coal may be transported to the plant via any convenient mode of transportation and fed into the processing system at coal grinding and drying facility 20 or at slurry mix tank 30.

EXAMPLES

The following Examples 1–8 illustrates the effects of subjecting run-of-mine coals to the feed coal selection process of the invention. The differences between run-of-mine coals and washed coals for Examples 1–8 are shown in Table 1. The ash content of each of the washed coals is substantially less than that of the run-of-mine coals. Also, the reduction in pyritic sulfur level which results from the coal preparaton (washing) step is quite significantly illustrated in Examples 1–8. The decrease in mineral and pyritic sulfur levels with the corresponding increase in carbonaceous content, and selection of coals having a lesser degree of fused carbon ring content, as detected by a vitrinite reflectance of less than about 0.70%, is shown to be favorable for coal conversion to fuels, and most notably pentane soluble oils.

A series of washed coals in Examples 1 through 8 were subjected to direct liquefaction. Each of these washed coals was ground and dried to a powdered form that would pass through a 150 mesh (Tyler) screen. The proximate, ultimate, sulfur forms and maceral analyses are shown in Table 1. Each of these coals was liquefied in the following manner:

A slurry comprised of 40 weight percent of Kentucky coal and 60 weight percent process solvent, having the composition as shown in Table 2, was prepared and passed through a one liter continuous stirred tank reactor at 2000 psig (140.7 kg/cm$^2$ gauge) hydrogen pressure with 28,000 SCF of hydrogen per ton (873.6 m$^3$ per metric ton) of coal at a nominal slurry rate, equivalent to a 40 minute residence time. The yields and product distribution for each of these coals are shown in Table 3.

Washed coals selected for direct liquefaction in Examples 1, 6 and 8 are coals having pyrite levels in the washed coals greater than 1.0 wt % and vitrinite reflectances less than 0.70%. Each of these coals give conversion of the reactive macerals (Conversion B) of 97% or greater. By comparison, the washed coals which would be rejected for processing in accordance with the invention show generally less coal conversion. By following the teachings of the invention, coals having the highest levels of reactive maceral conversions can be unequivocally selected and subjected to direct liquefaction to produce increased coal conversion and high yields of pentane soluble oils, as products.

Although the preceding examples are presented solely for purposes of illustration, it will be understood by those skilled in the art that the methods and improved proceses of the invention may be varied, altered or modified without departing from the spirit or scope of the invention as defined in the appended claims.

TABLE 1

Coal Composition

| | (Part I-A) | | | | | | (Part II-A) | | | | (Part III-A) | | |
|---|---|---|---|---|---|---|---|---|---|---|---|---|---|
| Example | 1 | | 2 | | 3 | | 4 | | 5 | | 6 | 7 | 8 |
| Sample Type | ROM | Washed | ROM | Washed | ROM | Washed | ROM | Washed | ROM | Washed | Washed | Washed | Washed |
| Proximate Analysis (Dry, Wt. %) | | | | | | | | | | | | | |
| Ash | 14.9 | 8.3 | 15.3 | 8.0 | 19.5 | 8.7 | 23.2 | 10.1 | 22.8 | 10.8 | 8.8 | 9.8 | 10.6 |
| Volatile Content | 40.3 | 45.6 | 38.4 | 41.5 | 34.9 | 39.9 | 34.9 | 41.5 | 36.2 | 39.9 | 41.9 | 40.9 | 40.0 |
| Fixed Carbon | 44.8 | 46.1 | 46.3 | 50.5 | 45.6 | 51.4 | 41.9 | 48.4 | 41.0 | 49.3 | 49.4 | 49.3 | 49.4 |
| Heating Value | | | | | | | | | | | | | |
| (Dry, Btu/lb) | 12157 | 13372 | 12416 | 13678 | 11680 | 13194 | 10858 | 13357 | 11184 | 12849 | 13165 | 12904 | 12758 |
| (Dry, K Calorie/kg) | 21882.6 | 24069.6 | 22348.8 | 24620.4 | 21024 | 23749.2 | 19544.4 | 24042.6 | 20131.2 | 23128.2 | 23697 | 2322.2 | 22964.4 |
| Ultimate Analysis (Dry, Wt. %) | | | | | | | | | | | | | |
| Ash | 14.9 | 8.3 | 15.3 | 8.0 | 19.5 | 8.7 | 23.2 | 10.1 | 22.8 | 10.8 | 8.8 | 9.8 | 10.6 |
| Carbon | 71.9 | 73.2 | 69.7 | 77.1 | 64.8 | 74.1 | 61.1 | 73.6 | 61.5 | 73.1 | 72.3 | 73.1 | 71.4 |
| Hydrogen | 5.3 | 5.3 | 4.9 | 5.2 | 4.6 | 5.4 | 3.9 | 5.1 | 4.3 | 5.1 | 5.2 | 5.3 | 5.2 |
| Nitrogen | 0.9 | 1.2 | 1.1 | 1.0 | 0.7 | 1.1 | 1.3 | 1.3 | 1.2 | 1.1 | 1.1 | 1.5 | 1.2 |
| Sulfur | 3.9 | 3.2 | 4.7 | 3.0 | 4.2 | 2.9 | 4.2 | 2.6 | 4.3 | 3.3 | 3.2 | 3.0 | 3.9 |
| Chlorine | 0.2 | 0.2 | 0.3 | 0.3 | 0.2 | 0.1 | 0.2 | 0.3 | 0.2 | 0.2 | 0.1 | 0.1 | 0.1 |
| Oxygen (diff.) | 2.9 | 8.6 | 4.1 | 5.5 | 5.9 | 7.8 | 6.2 | 6.9 | 5.7 | 6.3 | 9.4 | 7.2 | 7.6 |
| Forms of Sulfur (Dry, Wt. %) | | | | | | | | | | | | | |
| Pyritic | 1.9 | 1.3 | 1.9 | 0.6 | 2.1 | 0.8 | 1.8 | 0.7 | 2.7 | 0.9 | 1.1 | 1.1 | 1.4 |
| Sulfatic | 0.1 | 0.0 | 0.0 | 0.1 | 0.1 | 0.2 | 0.0 | 0.1 | 0.0 | 0.1 | 0.0 | 0.2 | 0.1 |
| Organic | 2.0 | 1.9 | 2.8 | 2.3 | 2.0 | 1.9 | 2.4 | 1.8 | 1.6 | 2.3 | 2.1 | 1.7 | 2.3 |
| Total | 4.0 | 3.2 | 4.7 | 3.0 | 4.2 | 2.9 | 4.2 | 2.6 | 4.3 | 3.3 | 3.2 | 3.0 | 3.8 |

| | (Part I-B) | | | | | | (Part II-B) | | | | (Part III-B) | | |
|---|---|---|---|---|---|---|---|---|---|---|---|---|---|
| Example | 1 | | 2 | | 3 | | 4 | | 5 | | 6 | 7 | 8 |
| Sample Type | ROM | Washed | ROM | Washed | ROM | Washed | ROM | Washed | ROM | Washed | Washed | Washed | Washed |
| Petrographic Data | | | | | | | | | | | | | |
| Maceral Analysis (WT. % DMMF) | | | | | | | | | | | | | |
| Vitrinite | — | 79.7 | — | 76.6 | — | 85.0 | — | 73.2 | — | 82.0 | 79.4 | 79.9 | 78.9 |
| Pseudovitrinite | — | 2.8 | — | 10.7 | — | 2.3 | — | 9.9 | — | 4.7 | 6.2 | 3.3 | 3.8 |
| Sporinite | — | 2.1 | — | 2.3 | — | 2.0 | — | 3.2 | — | 2.4 | 2.6 | 2.2 | 4.1 |
| Cutinite | — | 0.0 | — | 0.0 | — | 0.0 | — | 0.0 | — | 0.0 | 0.0 | 0.0 | 0.0 |
| Resinite | — | 0.0 | — | 0.1 | — | 0.0 | — | 0.9 | — | 0.3 | 1.5 | 0.6 | 0.8 |
| Fusinite | — | 7.3 | — | 5.4 | — | 3.9 | — | 4.1 | — | 3.1 | 2.1 | 5.8 | 3.0 |
| Semifusinite | — | 4.7 | — | 2.7 | — | 4.8 | — | 5.5 | — | 4.3 | 4.4 | 5.4 | 6.6 |
| Micrinite | — | 3.1 | — | 1.8 | — | 1.8 | — | 2.6 | — | 2.9 | 3.4 | 2.5 | 2.1 |
| Macrinite | — | 0.3 | — | 0.4 | — | 0.2 | — | 0.5 | — | 0.4 | 0.3 | 0.3 | 0.6 |
| Total Reactive Macerals (Wt. %) | — | 89.3 | — | 93.2 | — | 92.7 | — | 91.8 | — | 93.7 | 94.7 | 90.3 | 92.0 |
| Vitrinite Reflectance (%) | — | 0.48 | — | 0.72 | — | 0.56 | — | 0.72 | — | 0.55 | 0.53 | 0.54 | 0.61 |

TABLE 2

| Solvent Composition | |
|---|---|
| Ultimate Analysis, Wt. % | |
| Carbon | 87.8 |
| Hydrogen | 8.5 |
| Nitrogen | 0.7 |
| Oxygen | 2.7 |
| Sulfur | 0.5 |
| Boiling Range | 450°–900° (232.2–482.2° C.) |
| Molecular Weight | 205 |
| % Oils | 98.0 |
| % Asphaltenes | 1.9 |
| % Preasphaltenes | 0.1 |

TABLE 3

Liquefaction Performance (Part I)

| | Coal From Example | | | |
|---|---|---|---|---|
| | 1 | 2 | 3 | 4 |
| Temperature °F. | 840 | 840 | 840 | 840 |
| °C. | 448.9 | 448.9 | 448.9 | 448.9 |
| Res. Time (min.) | 40 | 40 | 40 | 40 |
| Hydrocarbon Gas (Wt. %) | 9.3 | 6.7 | 9.3 | 6.5 |
| CO, $CO_2$ (Wt. %) | 1.9 | 1.3 | 1.5 | 0.7 |
| $H_2S$, $NH_3$ (Wt. %) | 1.5 | 1.0 | 1.2 | 1.2 |
| Total | 12.7 | 9.0 | 12.0 | 8.4 |
| Total Oil (WT. %) | 17.5 | 10.2 | 18.9 | 24.6 |
| Solvent Refined Coal (Wt. %) | 56.0 | 63.6 | 55.8 | 52.1 |
| Insol. Organic Matter (Wt. %) | 13.2 | 16.8 | 13.7 | 14.7 |
| Sulfur in SRC (Wt. %) | 0.92 | 0.97 | 0.95 | 0.86 |
| Hydrogen Consumption (Wt. %) | 1.84 | 0.89 | 1.79 | 1.9 |
| Conversion A | 86.4 | 83.2 | 86.3 | 85.3 |
| Conversion B | 97 | 89 | 93 | 93 |

(Part II)

| | Coal From Example | | | |
|---|---|---|---|---|
| | 5 | 6 | 7 | 8 |
| Temperature °F. | 840 | 840 | 840 | 840 |
| °C. | 448.9 | 448.9 | 448.9 | 449.9 |
| Res. Time (min.) | 40 | 40 | 40 | 40 |
| Hydrocarbon Gas (Wt. %) | 5.3 | 4.0 | 4.4 | 7.9 |
| CO, $CO_2$ (Wt. %) | 1.4 | 1.2 | 1.2 | 1.2 |
| $H_2S$, $NH_3$ (Wt. %) | 1.8 | 1.5 | 1.4 | 2.1 |
| Total | 8.5 | 6.7 | 7.0 | 11.2 |
| Total Oil (WT. %) | 18.4 | 31.6 | 30.6 | 26.9 |
| Solvent Refined Coal (Wt. %) | 59.7 | 54.2 | 52.0 | 52.2 |
| Insol. Organic Matter (Wt. %) | 13.9 | 7.9 | 10.8 | 8.7 |
| Sulfur in SRC (Wt. %) | 0.98 | 1.14 | 1.01 | 0.79 |
| Hydrogen Consumption (Wt. %) | 1.09 | 1.58 | 1.37 | 2.5 |
| Conversion A | 86.1 | 92.1 | 89.2 | 91.3 |
| Conversion B | 92 | 97 | 99 | 99 |

What is claimed is:

1. A method for selection of feed coal for processing by direct liquefaction utilizing catalytic materials derived solely from said feed coal to produce low-ash, low-sulfur hydrocarbon products including solvent refined coal, and coal derived pentane soluble oil, which consists essentially of:

(a) removing a substantial portion of mineral material from a run-of-mine coal to provide a washed coal having at least about 1.0%, by weight of pyritic sulfur, (b) measuring the vitrinite reflectance of said coal, and (c) selecting for use as said feed coal substantially only said washed coal having a vitrinite reflectance of less than about 0.70%.

2. The method of claim 1 wherein said substantial portion of mineral material comprises about 25 to 75% by weight, of said run-of-mine coal.

3. The method of claim 1 wherein the measurement of said vitrinite reflectance of said coal is made prior to said removal of mineral matter.

4. The method of claim 1 wherein the measurement of said vitrinite reflectance of said coal is made subsequent to said removal of mineral matter.

5. The method of claim 1 wherein said removal of said mineral material is performed by washing techniques selected from the group consisting of jigging and dense media separation.

6. The method of claim 1 wherein said run-of-mine coal is of a rank lower than anthracite.

7. The method of claim 6 wherein said run-of-mine coal is ranked as bituminous.

8. An improved coal liquefaction process wherein coal is pulverized and slurried with a pasting oil, heated to at least about 700° to 900° F. and pressurized to about 500 to 5,000 psig, passed with a hydrogen-rich gas and catalytic material derived solely from the feed coal to at least one dissolver, wherein said slurry is retained for sufficient time to convert at least a portion of said feed coal into liquefied reaction product, following which time the reacted liquefaction product is passed to a separator from which vapor and condensate product streams are removed, including a residual bottoms product which is subsequently de-ashed and from which is obtained recycled process solvent, which can be recycled for use as said pasting oil, solvent refined coal distillates and solid refined coal, wherein the coal conversion in said reactor is improved by:

(a) removing a substantial portion of mineral matter from run-of-mine coal to provide a washed coal, and (b) measuring the vitrinite reflectance of said coal, (c) subjecting only said washed coal having a vitrinite reflectance of less than 0.70% and at least about 1.0% by weight of pyritic sulfur of said coal liquefaction process, whereby improved coal conversion and increased yields of pentane soluble oils and other valuable fuel fractions of said solvent refined coal are obtained.

9. The process of claim 8 wherein said substantial portion of mineral material comprises about 25 to 75%, by weight, of said run-of-mine coal.

10. The process of claim 8 wherein the measurement of said vitrinite reflectance of said coal is made prior to said removal of mineral matter.

11. The process of claim 8 wherein the measurement of said vitrinite reflectance of said coal is made subsequent to said removal of mineral matter.

12. The process of claim 8 where said removal of said mineral material is performed by washing techniques from the group consisting of jigging and dense media separation.

13. The process of claim 8 wherein said run-of-mine coal is of a rank lower than anthracite.

14. The process of claim 13 wherein said run-of-mine coal is ranked as bituminous.

15. In a direct coal liquefaction process wherein feed coal is slurried with a process derived solvent, heated to at least about 700° to 900° F. and pressurized to about 500 to 5,000 psig, passed with a hydrogen-rich gas and catalytic material derived solely from said feed coal to at least one dissolver, wherein said slurry is retained for sufficient time to react and dissolve at least a portion of said feed coal, following which a reacted product is passed to a separator from which separated vapor and condensed product streams are removed, including a residual bottoms product which is subsequently subjected to a solid separation from which is obtained a solid, substantially ash residue, process solvent which may be recycled and utilized as pasting oil, and solvent refined coal distillates and solids, the improvement which comprises utilizing as said feed coal only washed coal having a substantial amount of mineral matter removed, said washed coal having at least 1.0%, by weight, of pyritic sulfur content and a vitrinite reflectance of less than about 0.70%.

16. The process of claim 15 wherein said substantial portion of mineral material comprises about 25 to 75%, by weight, of said run-of-mine coal.

17. The process of claim 15 wherein the measurement of said vitrinite reflectance of said coal is made prior to said removal of mineral matter.

18. The process of claim 15 wherein the measurement of said vitrinite reflectance of said coal is made subsequent to said removal of mineral matter.

19. The process of claim 15 where said removal of said mineral material is performed by washing techniques from the group consisting of jigging and dense media separation.

20. The process of claim 15 wherein said run-of-mine coal is of a rank lower than anthracite.

21. The process of claim 20 wherein said run-of-mine coal is ranked as bituminous.

22. The process of claim 15 wherein said residual bottoms product is deashed by a critical solvent deashing process wherein:

(a) said residual bottoms product is mixed with the critical deashing solvent in a critical solvent deashing mix zone at temperatures ranging from 450° to 630° F. and pressures ranging from 750 to 1000 psig to form a CSD slurry, (b) said CSD slurry is passed into a first CSD separator from which a first light upper phase and a first lower heavy phase are separated, (c) removing said first lower phase comprising primarily critical deashing solvent which is recovered and returned to said critical solvent deashing mix zone, and an ash concentrate comprised of solid, mineral ash residue, unconverted coal macerals and a small amount of solubilized coal, (d) passing said first light upper phase to a second separator wherein a light second phase comprised of critical deashing solvent and a light fraction of solubilized coal, and a second heavy phase comprised of solubilized coal are separated and from which critical deashing solvent is isolated and recycle to said critical solvent deashing mix zone, (e) isolating a light solvent refined coal and returning the same to said coal slurry mix zone, (f) isolating a heavy solubilized coal product, a first portion of which is a product of the process, and a second portion of which is recycled to said coal slurry mix zone for incorporation into said pasting oil.

23. The process of claim 15 wherein said pasting oil may be selected from the group consisting of a material obtained from the coking of coal in a slot oven such as creosote oil, anthracene oil or other equivalent type, or process derived solvent that is recovered downstream from said dissolver.

24. The process of claim 23 wherein said process derived solvent has a boiling range between about 350° to 1050° F.

25. The process of claim 24 wherein said boiling range is between about 450° to 1050° F.

26. The process of claim 15 wherein the temperature at which said feed coal is slurried into said pasting oil may range from ambient up to about 450° F.

27. The process of claim 15 wherein said hydrogen-rich gas is supplied at a rate for the entire process which equals between about 10 to 80 Mscf per ton of said feed coal.

28. The process of claim 15 wherein a portion of said hydrogen-rich gas is injected through said preheater.

29. The process of claim 15 wherein a portion of said hydrogen-rich gas is injected into a first dissolver.

30. The process of claim 15 wherein said hydrogen-rich gas is partitioned between a preheater, a downstream dissolver and a first dissolver.

* * * * *

UNITED STATES PATENT AND TRADEMARK OFFICE

CERTIFICATE OF CORRECTION

PATENT NO. : 4,397,732

DATED : 9 August 1983

INVENTOR(S) : David S. Hoover and Edwin N. Givens

It is certified that error appears in the above-identified patent and that said Letters Patent is hereby corrected as shown below:

Col. 4, line 13 - Delete the word "from" and insert in its place --for--.

Col. 5, line 36 - Delete the words "aromaticity of level" and insert in its place --aromaticity or level--

Signed and Sealed this

*Thirteenth* Day of *December 1983*

[SEAL]

*Attest:*

GERALD J. MOSSINGHOFF

*Attesting Officer*

*Commissioner of Patents and Trademarks*